United States Patent [19]

Takegawa

[11] Patent Number: 4,886,094

[45] Date of Patent: Dec. 12, 1989

[54] PICKING CONTROLLER FOR A FLUID JET LOOM

[75] Inventor: Yujiro Takegawa, Ishikawa, Japan

[73] Assignee: Tsudakoma Corp., Ishikawa, Japan

[21] Appl. No.: 243,045

[22] Filed: Sep. 12, 1988

[30] Foreign Application Priority Data

Sep. 4, 1987 [JP] Japan ..... 62-226299

[51] Int. Cl.[4] ..... D03D 47/32; D03D 47/34; D03D 49/50

[52] U.S. Cl. ..... 139/452; 139/435

[58] Field of Search ..... 139/435, 452, 116

[56] References Cited

U.S. PATENT DOCUMENTS

| | | | |
|---|---|---|---|
| 4,458,726 | 7/1984 | Wenig | 139/116 X |
| 4,673,004 | 6/1987 | Rosseel et al. . | |
| 4,732,179 | 3/1988 | Takegawa | 139/435 |
| 4,744,393 | 5/1988 | Takegawa | 139/435 X |
| 4,784,189 | 11/1988 | Hellstrom | 139/452 X |

FOREIGN PATENT DOCUMENTS

| | | |
|---|---|---|
| 60-500338 | 3/1985 | Japan . |
| 62-125049 | 6/1987 | Japan . |

*Primary Examiner*—Andrew M. Falik

*Attorney, Agent, or Firm*—Wenderoth, Lind & Ponack

[57] ABSTRACT

A picking controller capable of automatically controlling the retaining member of the weft yarn measuring and storing unit of a picking device and the modes of operation of subnozzle groups respectively composed of subnozzles detects an actual arrival phase at which a picked weft yarn arrives at a fixed position on the arrival side of the loom, and then compares the actual arrival phase with a reference arrival phase to obtain the angular difference between the actual arrival phase and the reference arrival phase. The controller then determines a picking phase on the basis of the angular difference, and determines a releasing phase at which the retaining member is to be retracted so as to release the weft yarn stored on the measuring and storing drum of the weft yarn measuring and storing unit. The controller then determines jet starting phases and jet ending phases respectively for the groups of subnozzles on the basis of the running characteristics of the picked weft yarn, and controls the groups of subnozzles on the basis of the jet starting phases and the jet ending phases for sequential jetting.

4 Claims, 5 Drawing Sheets

PICKING CONTROLLER FOR A FLUID JET LOOM

BACKGROUND OF THE INVENTION

1. Field of the Invention:

The present invention relates to a picking device for a fluid jet loom and, more particularly, to a picking controller capable of automatically controlling the respective operating modes of the retaining member of the weft yarn measuring and storing device and subnozzle groups of a fluid jet loom, according to the actual running condition of a picked weft yarn.

2. Related Art:

Japanese Laid-Open Patent Publication Nos. 60-136379 and 60-259652 disclose systems which automatically regulate the jet starting phase of the main nozzle or the retaining member retracting phase for retracting the retaining member, such as a clamper, of a weft yarn measuring and storing device to release the weft yarn for picking, namely, the picking phase of a loom, so as to adjust an actual weft yarn arrival phase to a desired weft yarn arrival phase. Although the picking phase is regulated to adjust the moment of insertion of the weft yarn, the actual weft yarn arrival phase does not coincide correctly and stably with the desired weft yarn arrival phase, because these prior art systems do not regulate the mode of the sequential jetting operations of the subnozzle groups arranged sequentially along the running path of the picked weft yarn.

Japanese Laid-Open Patent Publication Nos. 60-500338 and 62-125049 disclose systems in which the mode of the sequential jetting operations of the subnozzle groups is regulated according to the actual running condition of the picked weft yarn, while the picking phase is fixed. Although the running mode of the picked weft yarn is improved by these systems, the weft yarn arrival phase varies necessarily, because the picking phase is not regulated.

Thus, ideal picking cannot be achieved by only regulating the picking phase or by only regulating the jetting mode of the subnozzle groups.

SUMMARY OF THE INVENTION

Accordingly, it is a principal object of the present invention to provide a picking controller capable of properly regulating both the picking timing and the mode of the sequential operations of the subnozzle groups of a fluid jet loom according to the actual running condition of the picked weft yarn.

To achieve the object of the invention, according to the present invention, a picking phase is determined on the basis of the angular (phase) difference between an actual weft yarn arrival phase and a reference weft yarn arrival phase; a retaining member retracting phase for retracting the retaining member of a weft yarn measuring and storing device is determined on the basis of the picking phase respective jet starting phases and jet ending phases for the subnozzle groups are determined according to the running condition of a picked weft yarn, and the subnozzle groups are respectively actuated sequentially at the jet starting phases and are respectively stopped sequentially at the jet ending phases.

Since both the picking phase and the jetting periods of the subnozzle groups are regulated, the actual weft yarn arrival phase always coincides correctly with the desired weft yarn arrival phase. Furthermore, since the mode of the sequential operations of the subnozzle groups is regulated for an optimum jetting operation according to the actual running speed of the picked weft yarn, the picked weft yarn runs optimally and the picked weft yarn arrives at the arrival position stably at the desired weft yarn arrival phase and accordingly, mispicks are reduced.

According to the present invention, the weft yarn releasing phase is regulated according to the actual running characteristics of the picked weft yarn and the mode of the sequential operations of the subnozzle groups is regulated accordingly. Therefore, the actual weft yarn arrival phase coincides accurately with the desired weft yarn arrival phase regardless of the variations in the running characteristics of the picked weft yarn. Furthermore, since the picked weft yarn runs optimally and since the weft yarn arrival phase is stabilized, problems including mispicks can be prevented.

The above and other objects, features and advantages of the present invention will become more apparent from the following description taken in conjunction with the accompanying drawings.

DETAILED DESCRIPTION OF THE PREFERRED EMBODIMENT

Figure 1:
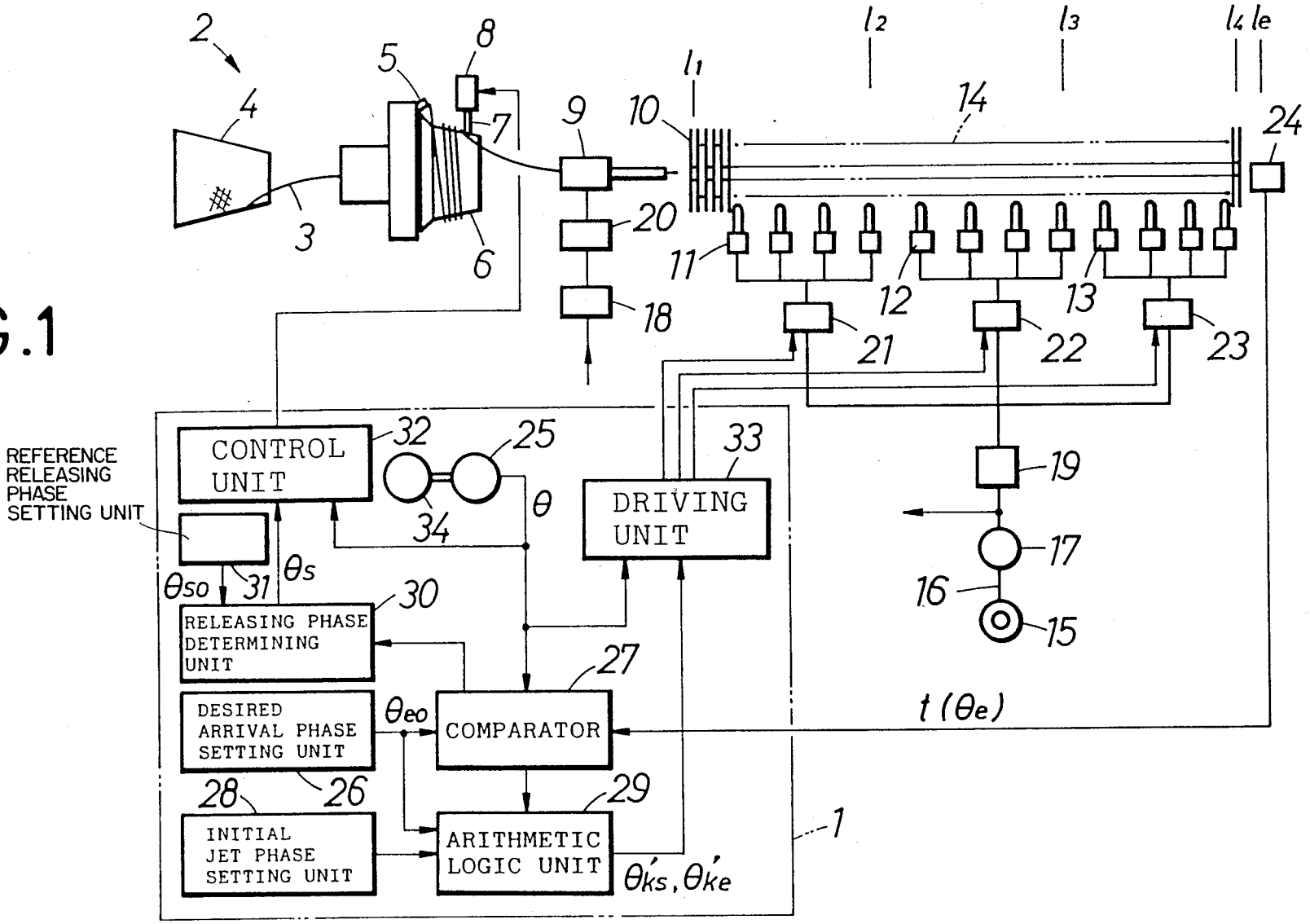
FIG. 1 is a block diagram of a picking controller in a preferred embodiment according to the present invention.

FIG. 1 shows a picking controller 1 in a first embodiment according to the present invention in which a picking device 2 is used in combination with the picking controller 1, both being incorporated into a fluid jet loom.

The picking device 2 measures and stores a weft yarn 3 of a desired length, and picks the stored weft yarn 3. For example, the weft yarn 3 is unwound from a yarn package 4, is passed through a rotary yarn guide 5 and is wound on the circumference of a stationary measuring and storing drum 6 by the rotary motion of the rotary yarn guide 5. The weft yarn 3 wound on the measuring and storing drum 6 is retained on the measuring and storing drum 6 by a retaining member 7. In measuring and storing a desired length of the weft yarn 3 on the measuring and storing drum 6, the free end of the weft yarn 3 is retained on the measuring and storing drum by passing the retaining member 7 through the circumference of the measuring and storing drum 6 by an actuator 8, such as a solenoid actuator. The weft yarn 3 wound on the measuring and storing drum 6 is stored on the measuring and storing drum 6 for picking. In picking the weft yarn 3, the retaining member 7 is retracted from the circumference of the measuring and storing drum 6 by the actuator 8, and then the weft yarn 3 is picked by a jet of pressurized fluid jetted by a picking nozzle 9 into a shed 14. While the picked weft yarn 3 runs along a running path defined by a reed 10, the picked weft yarn 3 is urged by the pressurized fluid jetted sequentially by, for example, subnozzles 11 of a first group, subnozzles 12 of a second group and subnozzles 13 of a third group. The pressurized fluid is supplied from a source of pressurized fluid 15 through a line 16 to a tank 17. Then, the pressurized fluid is supplied through a regulator 18 and an on-off solenoid valve 20 to the picking nozzle 9, and through a regulator 19 and on-off solenoid valves 21, 22 and 23 to the subnozzles 11, 12 and 13. The actual arrival phase t of the picked weft yarn 3 is detected for every picking cycle by an arrival sensor 24 disposed on the arrival side of the loom, and the arrival sensor 24 outputs a signal to the picking controller 1 upon the detection of the arrival of the picked weft yarn 3 at a fixed position.

The picking controller 1 comprises: a comparator 27 connected to the arrival sensor 24, an encoder 25 and a desired arrival phase setting unit 26; an arithmetic logic unit 29 connected to the desired arrival phase setting unit 26, the comparator 27 and an initial jet phase setting unit 28; a releasing phase determining unit 30 connected to the comparator 27 and a reference releasing phase setting unit 31; a control unit 32 connected to the encoder 25 and the releasing phase determining unit 30; and a driving unit 33 having input terminals connected to the encoder 25 and the arithmetic logic unit 29, and output terminals connected to the on-off solenoid valves 21, 22 and 23. The encoder 25 is connected mechanically to the main shaft 34 of the loom to detect the phase $\theta$ of the main shaft 34.

In the initial stage of operation of the loom after the loom has been started, the picking controller 1 controls the picking device 2 so that the retaining member 7 is retracted at a reference retracting phase $\theta_{s0}$ and the picking nozzle 9 is actuated accordingly; the subnozzles 11 of the first group, the subnozzles 12 of the second group and the subnozzles 13 of the third group function for reference periods between jet starting phases $\theta_{1s}$, $\theta_{2s}$ and $\theta_{3s}$, and jet ending phases $\theta_{1e}$, $\theta_{2e}$ and $\theta_{3e}$, respectively. The control unit 32 receives the reference releasing phase $\theta_{s0}$ through the releasing phase determining unit 30 from the reference releasing phase setting unit 31, receives the phase $\theta$ of the main shaft 34, and then controls the actuator 8 to retract the retaining member 7 for a desired period of time. A method disclosed in Japanese Laid-Open Patent Publication No. 60-65150 which determines data for controlling an actuator corresponding to the actuator 8 on the basis of a picking phase, a weft yarn arrival phase and the number of loops of weft yarn unwound from the measuring and storing drum for one picking cycle is suitably applicable to controlling the actuator 8.

Although the on-off solenoid valve 20 for the picking nozzle 9 is controlled by a method similar to that for controlling the actuator 8, since the fluid jetting operation of the picking nozzle 9 is not directly related to the picking phase, and since the fluid jetting operation of the picking nozzle 9 is a subordinate operation as compared with the retraction of the retaining member 7 in determining the picking phase and in view of its required sophisticated control for prejetting, main jetting and postjetting, the on-off solenoid valve 20 is controlled by a known special controller. The present invention regards the control of the picking nozzle 9 as an operation which is subordinate to the regulating of the picking phase and hence a concrete description thereof has been omitted.

Thus, the weft yarn 3 picked by the picking nozzle 9 at an initial velocity runs through the shed 14 while the subnozzles 11, 12 and 13 urge the picked weft yarn 3 toward the arrival position.

Figure 2:
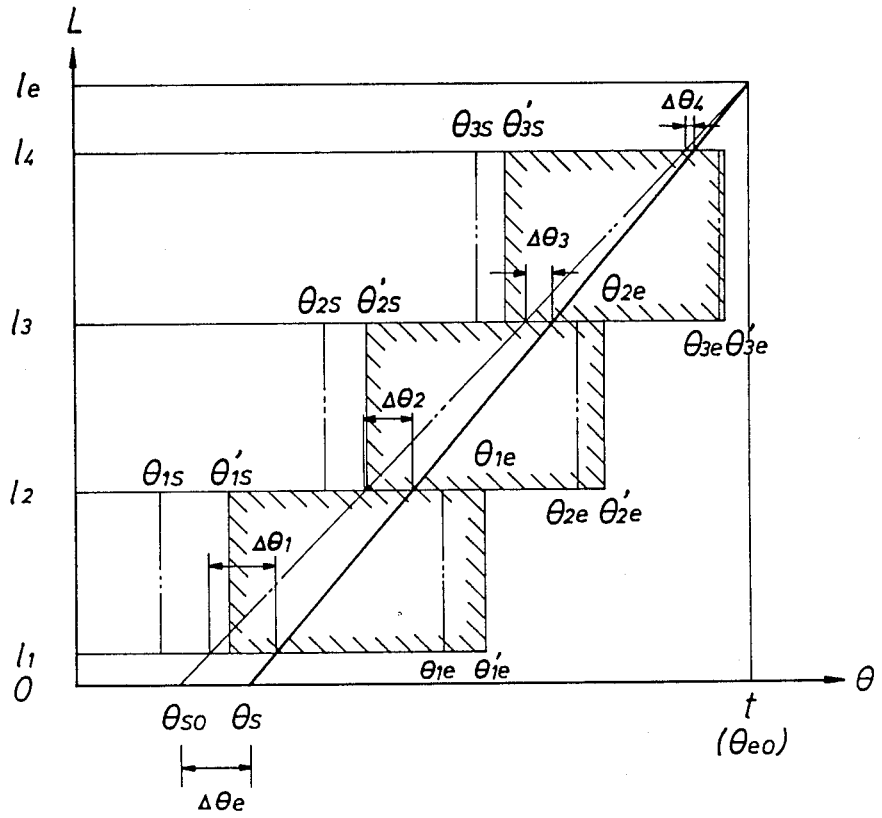
FIG. 2 is a graph showing the running characteristics of a picked weft yarn.
Figure 3:
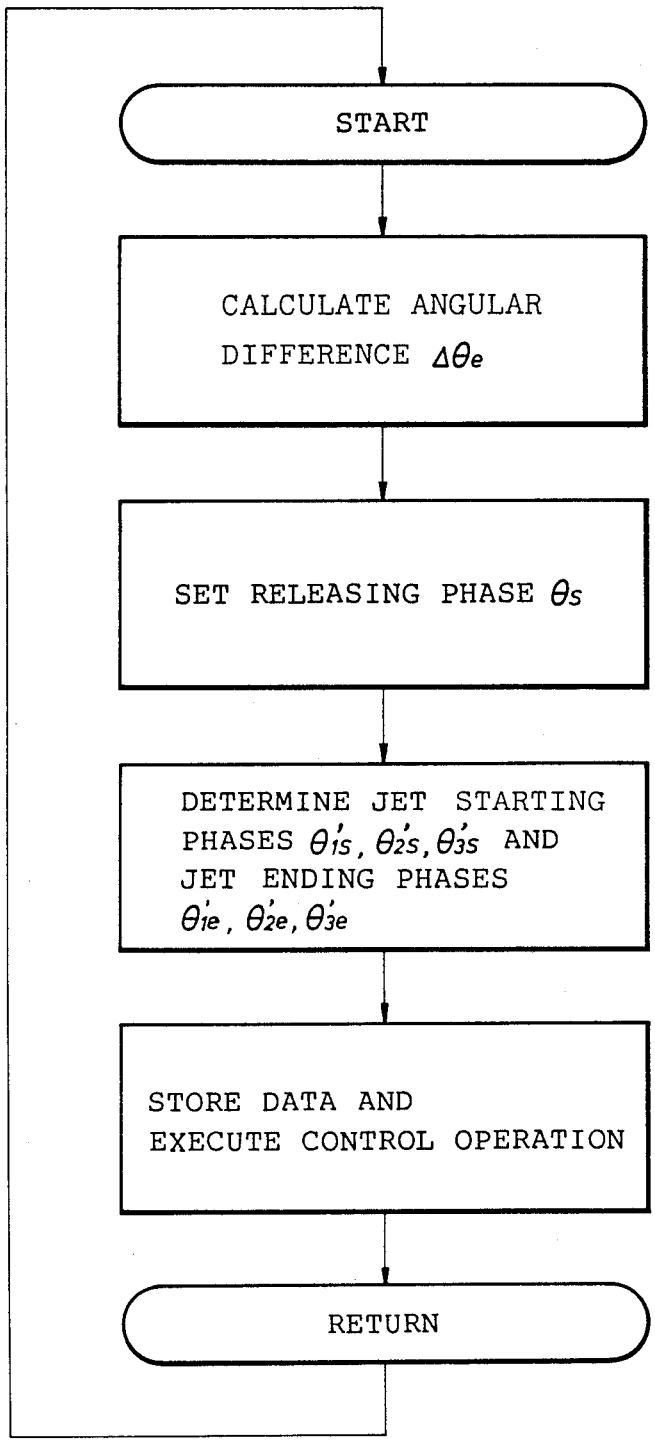
FIG. 3 is a flow chart of assistance in explaining a picking control procedure to be carried out by the picking controller of FIG. 1.

Suppose that the picked weft yarn 3 runs at a constant speed. Then, the running characteristics of the picked weft yarn 3 is represented by a linear equation. In FIG. 2, positive values for the phase $\theta$ of the main shaft 34 of the loom are measured to the right on the horizontal axis, and positive values ($l_1$, $l_2$, $l_3$, $l_4$, $l_e$) for the distance L of travel of the picked weft yarn 3 are measured upward on the vertical axis. In. FIG. 2, the standard running characteristics of the picked weft yarn 3 are indicated by a long and two short dashes line, which shows that the weft yarn 3 is picked at the reference releasing phase $\theta_{s0}$ and arrives at an arriving position corresponding to the arrival sensor 24 at an arrival phase $\theta_{e0}$ at arrival time t. On the other hand, the subnozzles 11, 12 and 13 jet the fluid sequentially during periods demarcated by alternate long and two short dashes lines in FIG. 2, namely, periods between the jet starting phases $\theta_{1s}$, $\theta_{2s}$ and $\theta_{3s}$ and the jet ending phases $\theta_{1e}$, $\theta_{2e}$ and $\theta_{3e}$, respectively. However, in a practical weaving operation, the running speed of the picked weft yarn 3 is caused to vary by variations in the physical properties of the weft yarn 3 and variations in the curling shape of the weft yarn 3 due to the variations of the diameter of the yarn package 4, and the actual arrival phase is thereby delayed or advanced relative to the desired arrival phase $\theta_{e0}$. Accordingly, the picking controller 1 starts a series of control operations shown in FIG. 3 to change the releasing phase $\theta_s$ every time the main shaft 34 of the loom rotates a predetermined number of times, or every predetermined number of picking cycles or when the actual arrival phase deviates from the desired arrival phase $\theta_{e0}$ more than a maximum limit and regulates the jetting period for the subnozzles 11, 12 and 13 accordingly.

First, the comparator 27 compares the actual arival phase $\theta_e$ with the reference arrival phase $\theta_{eo}$ to obtain the angular difference $\Delta\theta_e(=\theta_e-\theta_{e0})$ of the actual arrival phase from the reference arrival phase, and outputs a signal representing the angular difference $\Delta\theta_e$ to the arithmetic logic unit 29 and the releasing phase determining unit 30. Then, the releasing phase determining unit 30 changes the reference desired releasing phase $\theta_{s0}$ according to the angular difference $\Delta\theta_e$ to determine a new releasing phase $\theta_s$, and then the control unit 32 controls the actuator 8 to retract the retaining member 7 at the new releasing phase $\theta_s$. For example, when the actual arrival phase $\theta_e$ is delayed from the desired arrival phase $\theta_{e0}$ ($\Delta\theta_e$ is positive), the new releasing phase $\theta_s$ is advanced from the reference releasing phase $\theta_{e0}$ and, when the actual arrival phase $\theta_e$ is advanced from the desired arrival phase $\theta_{e0}$ ($\Delta\theta_s$ is negative), the new releasing phase is delayed from the desired releasing phase $\theta_{s0}$ by an angle corresponding to the absolute value of $\Delta\theta_e$ as indicated by a continuous line in FIG. 2. Then the retraction of the retaining member 7 is started at the new releasing phase $\theta_s$ and, after a predetermined period of time, the retaining member 7 is advanced to the circumference of the drum 6 for the next weft yarn measuring and storing operation. As mentioned above, the on-off solenoid valve 20 for the picking nozzle 9 is controlled in synchronism with the operation of the retaining member 7.

On the other hand, the arithmetic logic unit 29 receives data representing the angular difference $\Delta\theta_e$, and then determines new jet starting phases $\theta'_{1s}$, $\theta'_{2s}$ and $\theta'_{3s}$ and new jet ending phases $\theta'_{1e}$, $\theta'_{2e}$ and $\theta'_{3e}$ by obtaining shifting angles through the following proportional calculations and by subtracting the shifting angles from the previous jet starting phases and jet ending phases, respectively, on an assumption that the running characteristics of the picked weft yarn 3 is represented by a continuous line in FIG. 2.

$$\Delta\theta_1=\Delta\theta_e(l_e-l_1)/l_e$$
$$\Delta\theta_2=\Delta\theta_e(l_e-l_2)/l_e$$
$$\Delta\theta_3=\Delta\theta_e(l_e-l_3)/l_e$$
$$\Delta\theta_4=\Delta\theta_e(l_e-l_4)/l_e$$
$$\theta'_{1s}=\theta_{1s}-\Delta\theta_1$$
$$\theta'_{1e}=\theta_{1e}-\Delta\theta_2$$
$$\theta'_{2s}=\theta_{2s}-\Delta\theta_2$$
$$\theta'_{2e}=\theta_{2e}-\Delta\theta_3$$
$$\theta'_{3s}=\theta_{3s}-\Delta\theta_3$$
$$\theta'_{3e}=\theta_{3e}-\theta\Delta_4$$

Consequently, the subnozzles 11, 12 and 13 jet the fluid during new jetting periods indicated by the shaded areas, respectively, in FIG. 2. The driving unit 33 stores the new jet starting phases $\theta'_{1s}$, $\theta'_{2s}$ and $\theta'_{3s}$ and the new jet ending phases $\theta'_{1e}$, $\theta'_{2e}$, and $\theta'_{3e}$, and controls the on-off solenoid valves 21, 22 and 23 on the basis of the stored new jet starting phases and the stored new jet ending phases for the sequential jet starting and ending operation of the subnozzles 11, 12 and 13. Although the running speed of the picked weft yarn 3 varies depending on the variations in conditions, such as the diameter of the yarn package 4, affecting the running characteristics of the picked weft yarn 3, the picking conditions are regulated properly so that the actual arrival phase always coincides accurately with the desired arrival phase.

Figure 4:
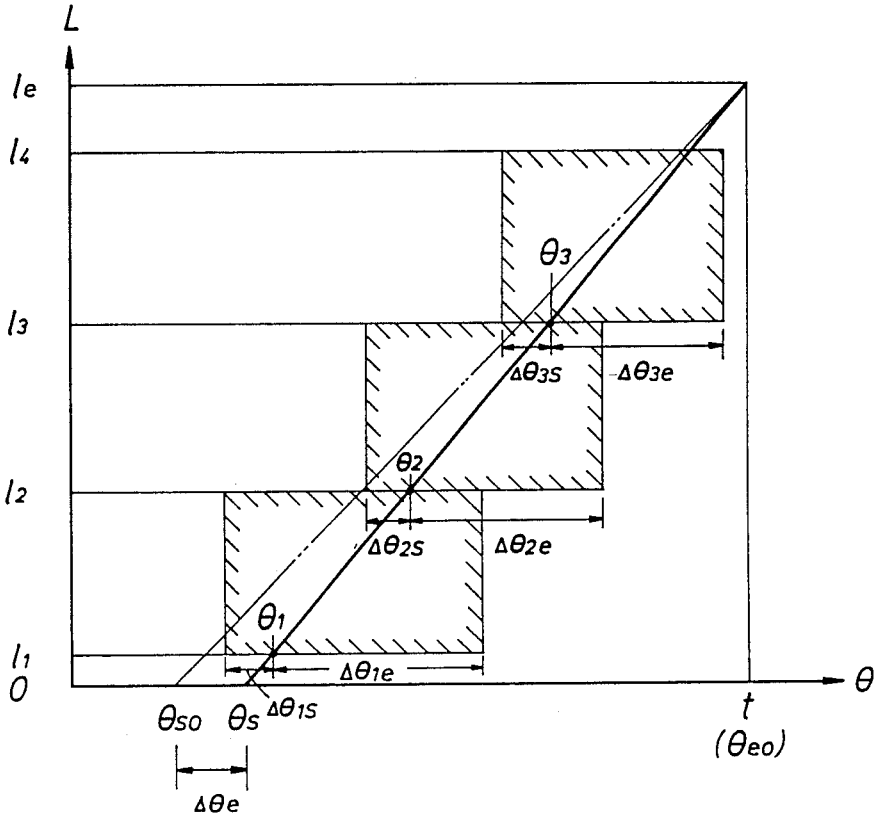
FIG. 4 is a graph showing the running characteristics of a picked weft yarn picked under the control of a picking controller in another embodiment according to the present invention.

In the foregoing embodiment, the phases of the jetting periods are shifted by angular shifts proportional to the variation in the gradient of the line representing the running characteristics of the picked weft yarn, namely, angular shifts calculated on the basis of the angular difference between the actual arrival phase and the desired arrival phase, to determine the new jetting periods respectively for the subnozzles 11, 12 and 13. However, the new jetting periods need not necessarily be determined on the basis of the angular difference, but may be determined by another method similar to that disclosed in Japanese Patent Application No. 61-236669 (corresponding to U.S. Ser. No. 104,757) in which the running characteristics of the picked weft yarn as indicated by the continuous line in FIG. 4 are determined on the basis of the detected actual arrival phase of the picked weft yarn; the passing phases $\theta_1$, $\theta_2$ and $\theta_3$ at which the picked weft yarn 3 passes positions at distances $l_1$, $l_2$ and $l_3$, respectively, are calculated on the basis of the running characteristics of the picked weft yarn 3; the prejetting angles $\Delta\theta_{1s}$, $\Delta\theta_{2s}$ and $\Delta\theta_{3s}$ are subtracted respectively from the passing phases, and the post jetting angles $\Delta\theta_{1e}$, $\Delta\theta_{2e}$ and $\Delta\theta_{3e}$ are added respectively to the passing phases to determine phases demarcating the jetting periods respectively for the subnozzles 11, 12 and 13.

Figure 5:
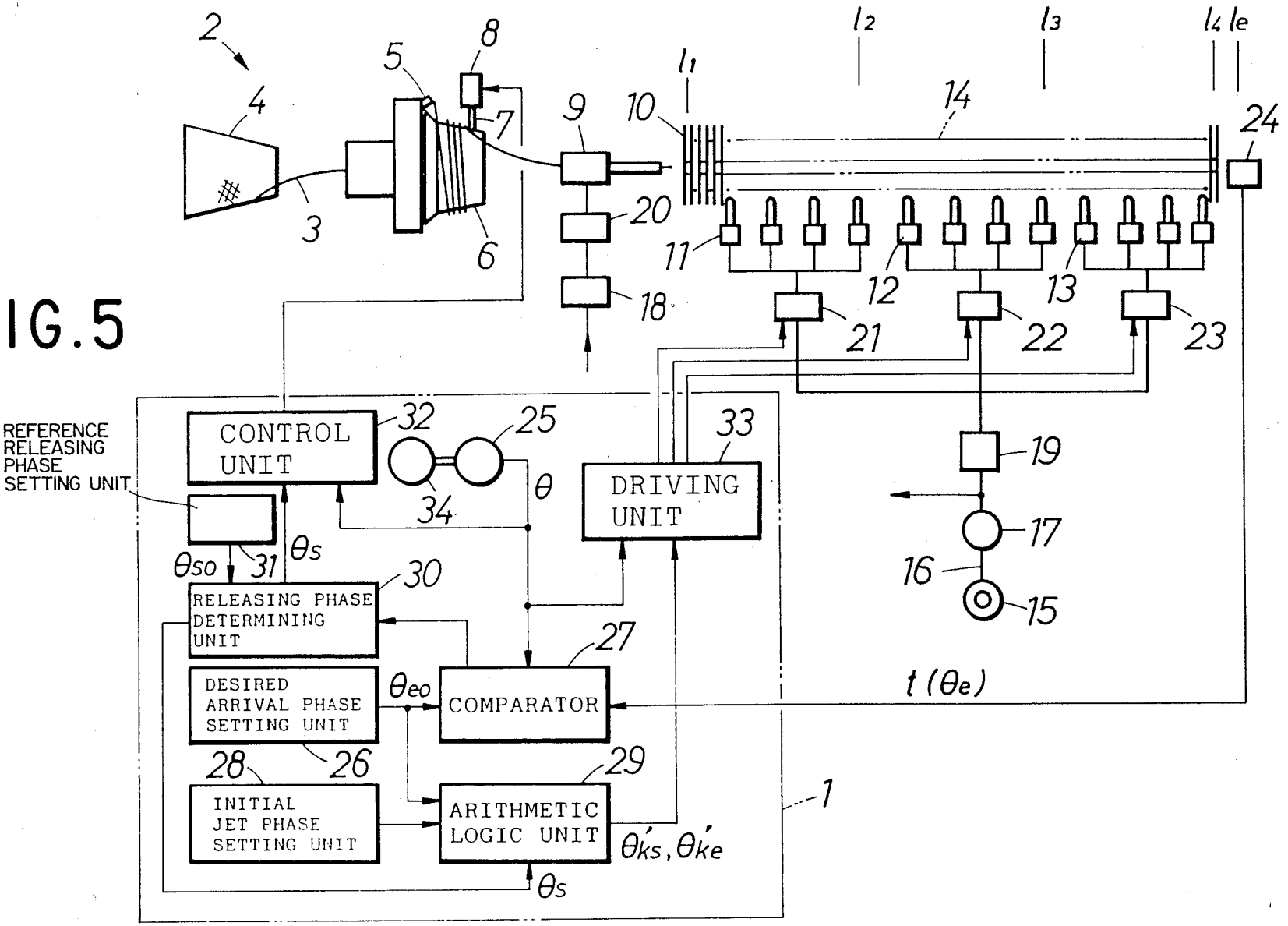
FIG. 5 is a block diagram of a picking controller in another embodiment according to the present invention.

According to the embodiment illustrated in FIG. 1, the jet starting phases $\theta'_{ks}$ (wherein k=1, 2, or 3) and the jet ending phases $\theta'_{ke}$ of the subnozzles 11, 12, 13 are determined by the arithmetic logic unit 29 independently of the releasing phase $\theta_s$. However, the jet starting phases $\theta'_{ks}$ and the jet ending phases $\theta'_{ke}$ may be determined by the arithmetic logic unit 29 using the releasing phase $\theta_s$ output from the releasing phase determining unit 30 as shown in FIG. 5.

The mean of a plurality of actual arrival phases $\theta_e$ sampled in a predetermined sampling period may be used instead of a single actual arrival phase $\theta_e$, for determining the new jetting periods.

The picking device 2 to be used in combination with the picking controller 1 of the present invention is not limited to the foregoing picking device provided with the retaining member 7; a known picking device equipped with a clamper may be used in combination with the picking controller 1.

Furthermore, although the picking controller 1 is illustrated as an assembly of fucntional elements for convenience in the foregoing description, those functional elements may be replaced by the control function, computing function and storage function of a microcomputer.

Although the invention has been described in its preferred for with a certain degree of particularity, it is to be understood that many variations and changes are possible in the invention without departing from the scope thereof.

What is claimed is:

1. A picking controller for use in combination with a picking device which draws out a weft yarn from a yarn package, stores the weft yarn temporarily on a measuring and storing drum, retracts a retaining member from the circumference of the measuring and storing drum by an actuator to release the weft yarn stored on the measuring and storing drum at a releasing phase of a loom, and inserts the weft yarn released from the measuring and storing drum in a shed by jets of fluid jetted by a picking nozzle and subnozzle groups each including subnozzles, comprising:

(a) an arrival sensor disposed on an arrival side of the loom to detect the arrival of a picked weft yarn at a fixed position on the arrival side of the loom and to provide a signal representing an actual arrival phase at which the picked weft yarn arrived at the fixed position on the arrival side of the loom;

(b) a comparator which compares the actual arrival phase detected by the arrival sensor with a desired arrival phase, to obtain the angular difference between the actual arrival phase and the desired arrival phase;

(c) a releasing phase determining unit which determines a new releasing phase on the basis of the angular difference;

(d) a control unit which compares the new releasing phase determined by the releasing phase determining unit with the phase of a main shaft of the loom and drives the actuator so as to retract the retaining member for a predetermined time upon the coincidence of the phase of the main shaft of the loom with the new releasing phase;

(e) an arithmetic logic unit which sets jet starting phases and jet ending phases meeting the actual running characteristics of the picked weft yarn respectively for the subnozzle groups each including subnozzles on the basis of the actual arrival phase detected by the arrival sensor; and (f) a driving unit which compares the jet starting phases and the jet ending phases determined by the arithmetic logic unit with the phase of the main shaft of the loom, and drives on-off valves provided respectively in lines connecting the groups of subnozzles to a source of pressurized fluid so that the subnozzles jet the pressurized fluid respectively for fluid jetting periods demarcated by the jet starting phases and the jet ending phases, respectively.

2. A picking controller according to claim 1, wherein the arithmetic logic unit determines the jet starting phases and the jet ending phases respectively for the groups of subnozzles through a proportional calculation using a graph showing the running characteristics of the picked weft yarn.

3. A picking controller according to claim 1, wherein the arithmetic logic unit determines the jetting periods respectively for the groups of subnozzles by subtracting prejetting angles from actual passing phases at which the picked weft yarn passed positions corresponding to the groups of subnozzles, respectively, and adding post-jetting angles to the actual passing phases, respectively.

4. A picking controller according to claim 1, wherein the arithmetic logic unit determines the jetting periods respectively for the groups of subnozzles from the releasing phase issued from the releasing phase determining unit.

* * * * *